US006529174B2

(12) United States Patent
Stjernman et al.

(10) Patent No.: US 6,529,174 B2
(45) Date of Patent: Mar. 4, 2003

(54) ARRANGEMENT RELATING TO ANTENNAS AND A METHOD OF MANUFACTURING THE SAME

(75) Inventors: Anders Stjernman, Lindome (SE); Erik Hemmendorff, Mölndal (SE); Daniel Byström, Göteborg (SE)

(73) Assignee: Telefonaktiebolaget LM Ericcson, Stockholm (SE)

( * ) Notice: Subject to any disclaimer, the term of this patent is extended or adjusted under 35 U.S.C. 154(b) by 0 days.

(21) Appl. No.: 09/741,013

(22) Filed: Dec. 21, 2000

(65) Prior Publication Data

US 2001/0028328 A1 Oct. 11, 2001

(30) Foreign Application Priority Data

Dec. 21, 1999 (SE) ..... 9904760

(51) Int. Cl.[7] ..... H01Q 15/02

(52) U.S. Cl. ..... 343/909; 343/755; 343/756; 343/778

(58) Field of Search ..... 343/700 MS, 753, 343/754, 755, 756, 779, 781 P, 778, 795, 909; H01Q 15/02

(56) References Cited

U.S. PATENT DOCUMENTS

| | | | | |
|---|---|---|---|---|
| 3,924,239 A | | 12/1975 | Fletcher et al. | |
| 3,975,738 A | | 8/1976 | Pelton et al. | |
| 4,017,865 A | | 4/1977 | Woodward | |
| 4,125,841 A | | 11/1978 | Munk | |
| 4,126,866 A | | 11/1978 | Pelton | |
| 4,656,487 A | | 4/1987 | Sureau et al. | |
| 4,905,014 A | | 2/1990 | Gonzalez et al. | |
| 5,451,969 A | * | 9/1995 | Toth et al. | 343/781 CA |
| 5,864,322 A | * | 1/1999 | Pollon et al. | 343/909 |
| 6,031,506 A | * | 2/2000 | Cooley et al. | 343/840 |

OTHER PUBLICATIONS

Pozar et al., "Design of Millimetre Wave Microstrip Reflectarrays," IEEE Transactions on Antennas and Propagation, vol. 45, No. 2, Feb. 2, 1997, pp. 287–295.

Dahlsjö, "Antenna Research and Development at Ericsson", IEEE Antennas and Propagation Magazine, vol. 34, No. 2, Apr. 1992, pp. 7–17.

* cited by examiner

*Primary Examiner*—Tho Phan
(74) *Attorney, Agent, or Firm*—Burns, Doane, Swecker & Mathis, L.L.P.

(57) ABSTRACT

The present invention refers to an arrangement in an antenna, the arrangement comprising: an electrically thin microwave phasing structure including a support member, a reflective arrangement for reflecting microwaves within a frequency operating band and supported by said supporting member, and a phasing arrangement of electromagnetically-loading structures, said electromagnetically-loading structures being interspaced from each other and disposed at a distance from said reflective arrangement by a support matrix to provide said emulation of said desired reflective surface of selected geometry. The electromagnetically-loading structures are arranged on at least two substrate layers in at least two planes.

31 Claims, 13 Drawing Sheets

ARRANGEMENT RELATING TO ANTENNAS AND A METHOD OF MANUFACTURING THE SAME

TECHNICAL FIELD OF THE INVENTION

The present invention relates to an antenna arrangement, the arrangement comprising an electrically thin microwave phasing structure including a support member and a reflective means for reflecting microwaves within a frequency operating band supported by said supporting member. The support member at a distance from the reflective means supports an arrangement of electromagnetic-loading structures.

Furthermore, methods are provided for designing and manufacturing electrically thin microwave phasing structures for electromagnetically emulating desired reflective surfaces and focussing elements of selected geometry.

DESCRIPTION OF THE RELATED ART

U.S. Pat. No. 4,905,014 discloses an electrically thin microwave phasing structure for electromagnetically emulating a desired reflective surface of selected geometry over an operating frequency band. The microwave phasing structure comprises a support matrix and a reflective means for reflecting microwaves within the frequency-operating band. The support matrix supports the reflective means. An arrangement of electromagnetically loading structures is supported by the support matrix at a distance from the reflective means, which can be less than a fraction of the wavelength of the highest frequency in the operating frequency range. The electromagnetically loading structures are dimensioned, oriented, and interspaced from each other and disposed at a distance from the reflective means, as to provide the emulation of the desired reflective surface of selected geometry. Another aspect of the present invention is the use of the electrically thin microwave phasing structure for electromagnetically emulating a desired microwave focusing element of a selected geometry.

Other phasing structures are also known, e.g. through U.S. Pat. Nos. 4,656,487; 4,126,866; 4,125,841; 4,017,865; 3,975,738; and 3,924,239.

In "Design of Millimeter Wave microstrip Reflectarrays", By David M. Pozar et al, IEEE Transactions on Antennas and Propagation, Vol. 45, No., Feb. 2, 1997, pages 287–295, a theoretical modelling and practical design of a millimeter wave reflect arrays using microstrip patch elements of variable size are discussed.

One major problem related to antennas according to above-mentioned documents in general and the arrangement according to U.S. Pat. No. 4,905,014 in particular, is the cross coupling problem between the crossing elements of the cross-shaped or similar dipoles in one plane.

Flat parabolic surface technology is based on a dipole pattern over a ground plane with a dielectric material there between.

Preferably, the spacing between the dipoles is chosen to avoid grating lobes, i.e. it must be less than half a wavelength.

Experiments have shown that the width of the dipoles not only affects the bandwidth of the reflector but also the phase shift and phase gap of the reflected wave. The phase gap is in an interval in the full 360 degree phase range to which phase shift is not possible.

The length of the dipoles affects the reflected phase shift. This is due to the fact that a dipole's characteristic impedance is dependent on its length. A dipole is said to be resonant when the reactive part of the impedance is zero, i.e., when the input admittance is infinite. For a single dipole this occurs when the dipole length is approximately a half wavelength.

A small dipole width results in a small phase gap but the dipole shift becomes more sensitive of frequency; decreasing the phase gap results in an undesired decrease in the bandwidth. The phase shift also depends on the incremental angle.

The impedance Z of an antenna determines the efficiency with which it acts as a conductor between the propagation medium to the feeder and the transmission line connecting it to the system with which it operates. If there is an array of dipoles it is necessary to consider not only the self impedance of each dipole but also the mutual coupling between the dipoles. The mutual impedance increases when the distance between the dipoles decreases. It is therefore desired to maximize the distance between the elements.

It is assumed that the equivalent circuit of a single dipole contains three parallel loads: a loss conductance $G_L$, a transmission admittance $Y_T$ and a dipole susceptance B. The loss conductance is due to the finite conductivity of the dipole, which in turn is due to losses in the conductor and the dielectric material. Depending on the incremental angle, the dipole excites an electromagnetic wave with different phases because the dipole radiation scattered from the dipole to the ground plane has different path lengths through the dielectric layer. This effect is illustrated by the admittance $Y_T$. A dipole is said to be resonant when the reactive part of the input impedance is zero, i.e. the input admittance is infinite. For a single dipole, this occurs when the dipole length is approximately a half wavelength.

When the antenna is a linear array of dipoles, the equivalent circuit of the dipole has to be modified. The mutual impedance between the dipoles has to be considered, whereby a mutual admittance $Y_{mn}$ between dipoles m and n, where <> n and self-impedance of dipole m when m=n, is added in parallel to above-mentioned loads. However, the problem is even more complex where two-dimensional arrays of dipoles are employed.

SUMMARY

One object of the present invention is to provide a solution to the above-mentioned problem and provide an enhancement to the antenna reflectors known through to the prior art, which is commercially usable in wide range of applications.

Another object of the present invention is to provide a reflector device in an antenna arrangement, which is easy to produce and configure for several types of applications.

Yet another object of the present invention is to provide a flat antenna reflector with more compact dipole configuration. Preferably, longer dipoles can also be arranged.

One additional object of the present invention is to provide a small, inexpensive, easily modified reflector replacement in radio-link arrangements, preferably microwave link antennas, in a cellular network, which further is simple to assemble for providing different types of lobe configurations, such as point to point and point to multipoint and which replaces parabolic reflectors.

The invention also has as an object to provide an antenna reflector, which can be mounted flat on a carrying surface and which can be arranged to shape the main lobe, change the direction of the beam, be offset fed and have low cross polarization.

Moreover, the antenna reflector according to the present invention reflects very little of the cross polar radiation and it reflects the radiation that has a frequency outside the specified bandwidth very poorly, provides a low main beam RCS (Radar to Cross Section) for the frequencies outside the bandwidth which the antenna is designed for.

Therefore, the electromagnetic-loading structures are arranged on at least two substrate layers in at least two planes.

Preferably, the dipoles are arranged in an angel on one side of said substrate on each layer, which allows longer dipoles.

In one embodiment the dipoles have a substantially cross-shaped configuration having substantially vertical and horizontal dipole elements arranged in different planes, which allows circular polarization.

Preferably, the dipoles have different sizes and/or shapes, which result in different lobe shapes and/or directions, and also different frequency reflections.

The arrangement can be configured as a reflector in a center-fed broad side antenna, a center-fed antenna with a tilted main lobe, an offset-fed broad side antenna, a Point-to-Point or Point-to-Multipoint antenna.

Preferably, the dipoles are arranged on different substrates, but they may also be arranged on different sides of a substrate.

The invention also refers to an antenna at least comprising one electromagnetic feeding arrangement and reflector arrangement, which comprises an electrically thin microwave phasing structure including a support member, supported by said supporting member a reflective means for reflecting microwaves within a frequency operating band and a phasing arrangement of electromagnetic-loading structures supported by said support matrix. The electromagnetic-loading structures are interspaced from each other and disposed at a distance from said reflective means by said support matrix so as to provide said emulation of said desired reflective surface of selected geometry. Moreover, the electromagnetic-loading structures are arranged on at least two substrate layers in at least two planes.

In one embodiment the antenna comprises different feeders for different planes.

In still a further embodiment the antenna comprises a further reflector facing said reflector arrangement, which is arranged to reflect vertically or horizontally polarized electromagnetic waves and said further reflector is arranged to rotate said vertical or horizontal polarization to horizontal or vertical polarization.

The invention also concerns a method of producing an antenna reflector. The method comprises the steps of: determining characteristics of an antenna employing the reflector; calculating a distance between the feeder and each dipole with respect to the input characteristics; calculating a phase shift for the dipoles; and using said calculated phase shift for calculating the length of the dipoles. The characteristics include antenna size, type, frequency band, feeder type, feeder size etc. For calculating said phase shift an analyzing procedure is used, which analyses: a microstrip dipole surrounded by an infinite number of identical dipoles; dual layer dichroic structures, which consist of two parallel metallic screens (gratings) separated by one/several dielectric layers; and a single grating surrounded by a number of dielectric layers that are considered to be electrically close to the grating.

BRIEF DESCRIPTION OF THE DRAWINGS

In the following, the invention will be described further in a non-limiting way with reference to the accompanying drawings in which.

DETAILED DESCRIPTION OF THE EMBODIMENTS

Figure 1:
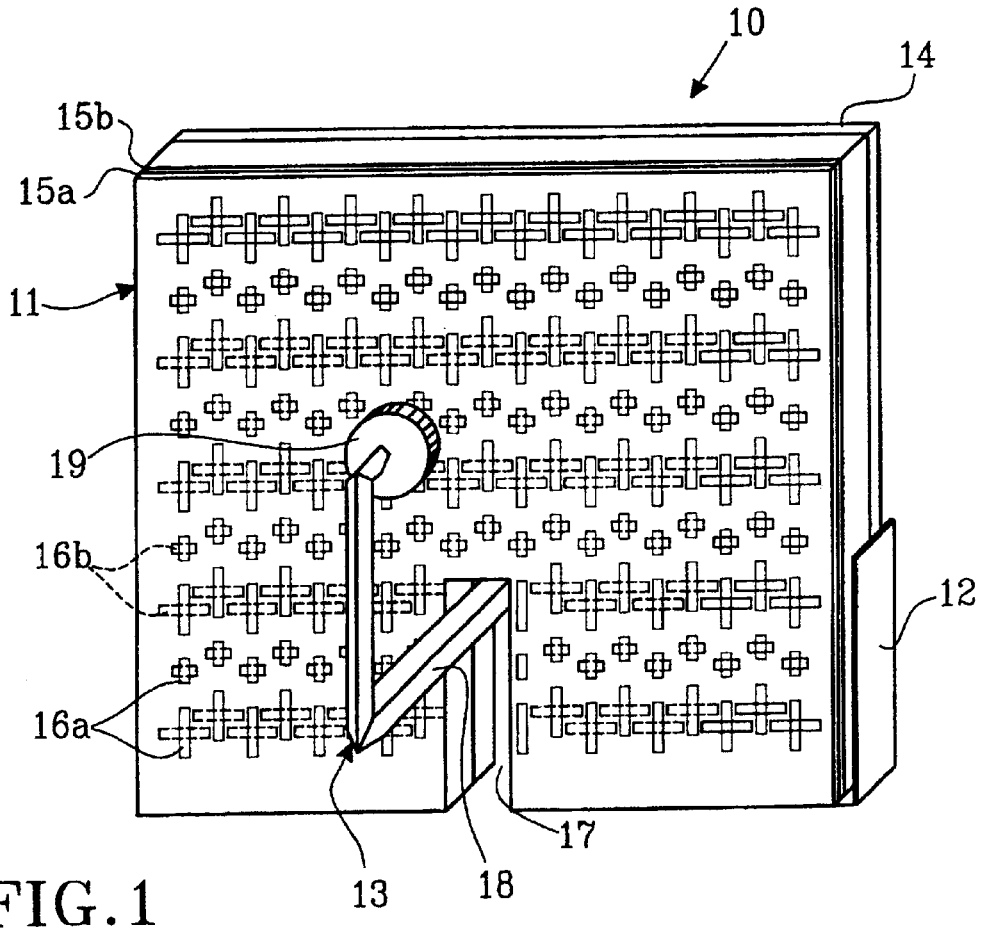
FIG. 1 is a schematic illustration of an embodiment of the invention in perspective.

FIG. 1 shows an antenna arrangement 10 including a reflector section 11 according to the invention. The antenna arrangement further comprises a supporting structure 12 and feeding arrangement 13.

The substantially rectangular reflector section 11 consists of a ground plane 14, dielectric layers 15*a* and 15*b*, and dipoles 16*a* and 16*b* with different lengths. Vertical dipoles on the first layer 15*a* are denoted with 16*a* and horizontal dipoles on the second layer 15*b* are denoted with 16*b*. The dipoles are arranged with different lengths. The reflector section (henceforth simply called the reflector), according to this embodiment is provided with a notch 17, which allows insertion of the feeding arrangement in front of the reflector. The notch 17 may however be disregarded if another feeding position and/or arrangement is used.

The support structure 12 comprises a frame, which allows the reflector 11 to be inserted from one open side of the frame. It also may support the feeding arrangement.

The feeding arrangement 13, which is of a conventional type, comprises a feeding horn 18 and a head 19.

This embodiment is characterised by shifting the phase of the reflected beam by differing the dipole lengths. Furthermore, the dipoles 16*a* and 16*b* are so arranged that they form an array of a substantially parallel, dashed line configuration in horizontal and vertical directions.

Figure 2:
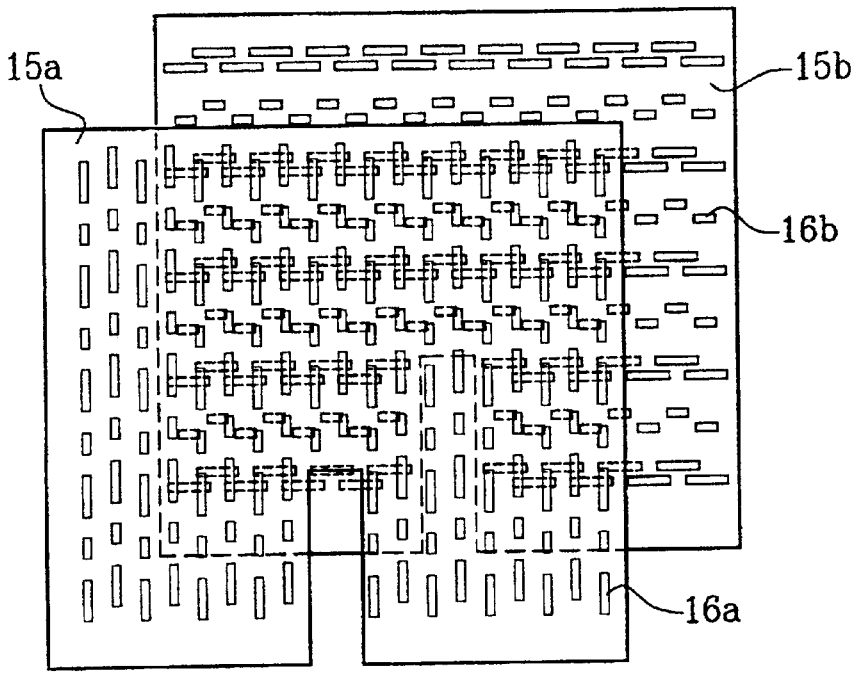
FIG. 2 is a schematic illustration of the dipole layers of the reflector of the antenna according to FIG. 1.

In FIG. 2 the dielectric-dipole layers 15*a* and 15*b* according to FIG. 1 are shown separated.

Figure 3A:
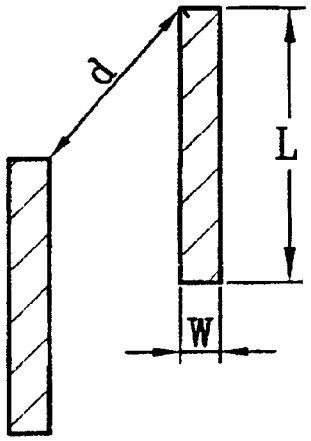
FIGS. 3*a*, 3*b* are illustrations for defining parameters.
Figure 3B:
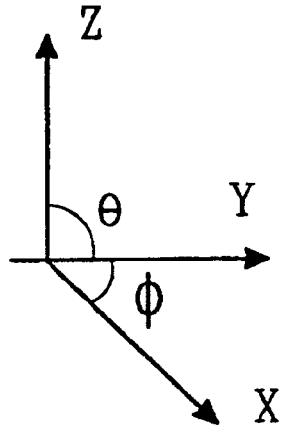

For better understanding the invention, following parameters are defined in conjunction with FIGS. 3*a* and 3*b*. FIG. 3*a* shows two dipoles 16 and related parameters, wherein w is the width of the dipole, L is the length of the dipole and d is the shortest distance between two physical dipoles. Moreover, ordinary right Cartesian coordinate system is used to define the angles θ and ϕ, as seen in FIG. 3*b*. Thus, the radiated field E from the feeder is assumed to be:

$$E = \frac{(E_\theta \cdot \cos\theta + E_\varphi \cdot \cos\phi) \cdot e^{-jkr}}{r} \tag{1}$$

where r is distance and k is the wave number.

In the following, some examples disclosing the reflectors according to the invention for different types of antennas will be described.

Figure 4:
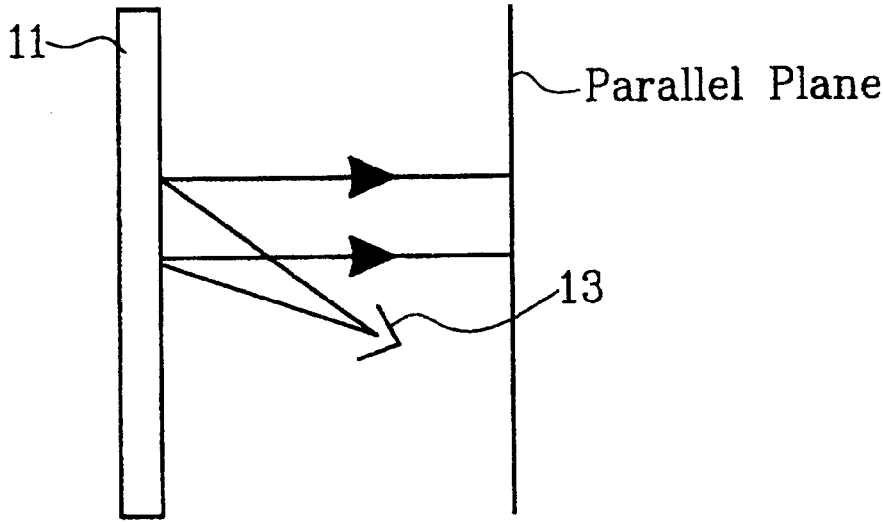
FIG. 4 is schematic side view of a center-fed antenna with a broadside lobe.

The first example concerns a center-fed broad side antenna reflector, which is illustrated schematically in FIG. 4. The reflector 11 is fed by means of a feeding arrangement 13 substantially at a centre section. Arrows represent beams. On an ideal broadside reflector antenna the phase length from the feeders phase center to a point infinitely far away in the broadside direction is the same independent of which route the radiation travels to reach there, differing only by 2nπ, where n is an integer. It is also valid as if the phase was constant on a plane perpendicular to the broadside (the parallel plane). In the case of a conventional reflector (parabolic) antenna, this implies that the physical length is the same independent of the route taken, but in the present case this is not valid since the phase is shifted by differing the dipole lengths to obtain the same effect.

Referring to FIG. 4, to calculate the needed phase shift and thereby the dipole lengths, the length from the feeders phase center to a point on a perpendicular plane and the plase length using equation (2) is calculated.

$$PhaseLength = \sqrt{(z^2 + x^2 + y^2)} \cdot \frac{2\pi}{\lambda} \tag{2}$$

where x, y and z are coordinates in a Cartesian coordinate system with the origin in the feeders phase center and λ is the wavelength.

The required phase shift of the dipole is then calculated using equation (3) where Plane-Phase is the phase at the perpendicular plane.

$$\text{Phase shift} = \text{Phase dipole} + \text{Phase adjust} \tag{3}$$

$$\text{Plane phase} = \text{Phase length} + \text{Phase shift} \tag{4}$$

"Phase adjust" is chosen so that as few dipole phase shifts as possible are in the phase gap since this will degrade the performance of the antenna. Once the needed phase shift is known all that is needed is to cross-reference the phase-shift with the list of dipoles and their respective phase shifts which is generated according to the method described later.

The farfield radiation is calculated assuming that the feeder radiates like a circular aperture, through:

$$E_\theta = C_2 \cdot \sin\phi \cdot \frac{J_1(Z)}{Z} \tag{5}$$

$$E_\phi = C_2 \cdot \cos\theta \cdot s\cos\phi \cdot \frac{J_1'(Z)}{1 - (Z/\chi_{11}')^2} \text{ where}$$

$$J_1'(Z) = J_0(Z) - \frac{J_1'(Z)}{Z} \tag{6}$$

$$C_2 = j \cdot \frac{kaE_0 \cdot J_{11}'(\chi_{11}') \cdot e^{-jkr}}{r}$$

$$Z = ka \cdot \sin\theta$$

$$r = \sqrt{(x^2 + y^2 + z^2)}$$

$$\theta = a\cos\left(\frac{z}{\sqrt{(x^2 + y^2 + z^2)}}\right)$$

$$\phi = a\tan\left(\frac{y}{x}\right)$$

$J_0$ and $J_1$ are the Bessel functions, a is the (assumed) aperture diameter, k is the wave number, and θ and ϕ are angles relative to the feeder. $\chi_{11}$ is the first zero crossings for a Bessel function of first degree.

The field radiated by the aperture at each dipole is calculated by equation (7), which takes into consideration the antenna pattern of the feeder and the distance between the feeder and dipole.

$$E = \frac{(E_\theta \cdot \cos\theta + E_\varphi \cdot \cos\phi) \cdot e^{-jkr}}{r} \cdot e^{-jk \cdot phaseshift} \tag{7}$$

In the equation (7) it is assumed that the dipoles only reflect the co-polar radiation into consideration.

This radiation is phase shifted by the dipole and re-radiated. The farfield antenna pattern is derived by multiplying the dipole radiation by the reflectors array factor and a dipole's element factor as seen in equation (8).

$$E_{farfield} = E \text{ . Array factor . Element factor} \tag{8}$$

The array factor is calculated using the inverse Fourier transforms on an array in which each element in the array contains the radiation from a single dipole. Since the array consists of several different dipole lengths, the element factor for a dipole of medium length, e.g. 5 mm is used. Equation (9) shows how the element factor for a radiating patch antenna, which is the approximation used for the dipoles is calculated.

$$E_{element} = \frac{\left(\sin\left(\frac{kH}{2}\cdot\cos\phi\right)\right)}{\left(\frac{kH}{2}\cdot\cos\phi\right)}\cdot\cos\left(\frac{kL_{eff}}{2}\cdot\sin\phi\right) \tag{9}$$

$$H_{element} = \sin\Theta\frac{\left(\sin\left(\frac{kH}{2}\cdot\sin\Theta\right)\right)\cdot\left(\sin\left(\frac{kW}{2}\cdot\cos\Theta\right)\right)}{\left(\frac{kH}{2}\cdot\sin\Theta\right)\left(\frac{kW}{2}\cdot\cos\Theta\right)}$$

Where $\Theta$ is modulation angle,

H is the dipole's height above the ground plane,

W is the dipole width and $$L_{eff} = L + 2\cdot\Delta L \tag{10}$$

$$\Delta L = h\cdot 0.412\cdot\frac{(\varepsilon_{reff}+0.3)\left(\frac{W}{h}+0.264\right)}{(\varepsilon_{reff}-0.258)\left(\frac{W}{h}+0.8\right)}$$

$$\varepsilon_{reff} = \frac{\varepsilon_r+1}{2} + \frac{\varepsilon_r-1}{2}\cdot\left(1+\frac{12H}{W}\right)^{-\frac{1}{2}} + F(\varepsilon_r, H) - 0.217(\varepsilon_r-1)\frac{T}{\sqrt{WH}}$$

$$F(\varepsilon_r, H) = 0.02(\varepsilon_r-1)\left(1-\frac{W}{H}\right)^2$$

T is the dipole thickness.

Figure 7A:
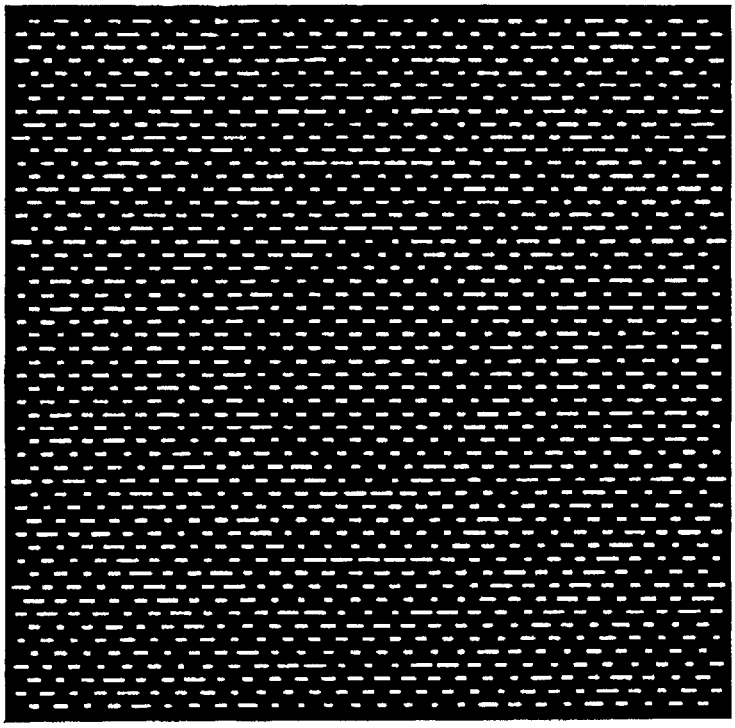
FIG. 7A is dipole structure of the center-fed antenna with broadside lobe.

FIG. 7A shows the dipole pattern for a center fed antenna reflector with broad side lobe. It appears from the figure that shorter dipoles are concentrated to the center of the reflector and they are surrounded by substantially circular patterns of long and short dipoles, respectively.

Figure 5:
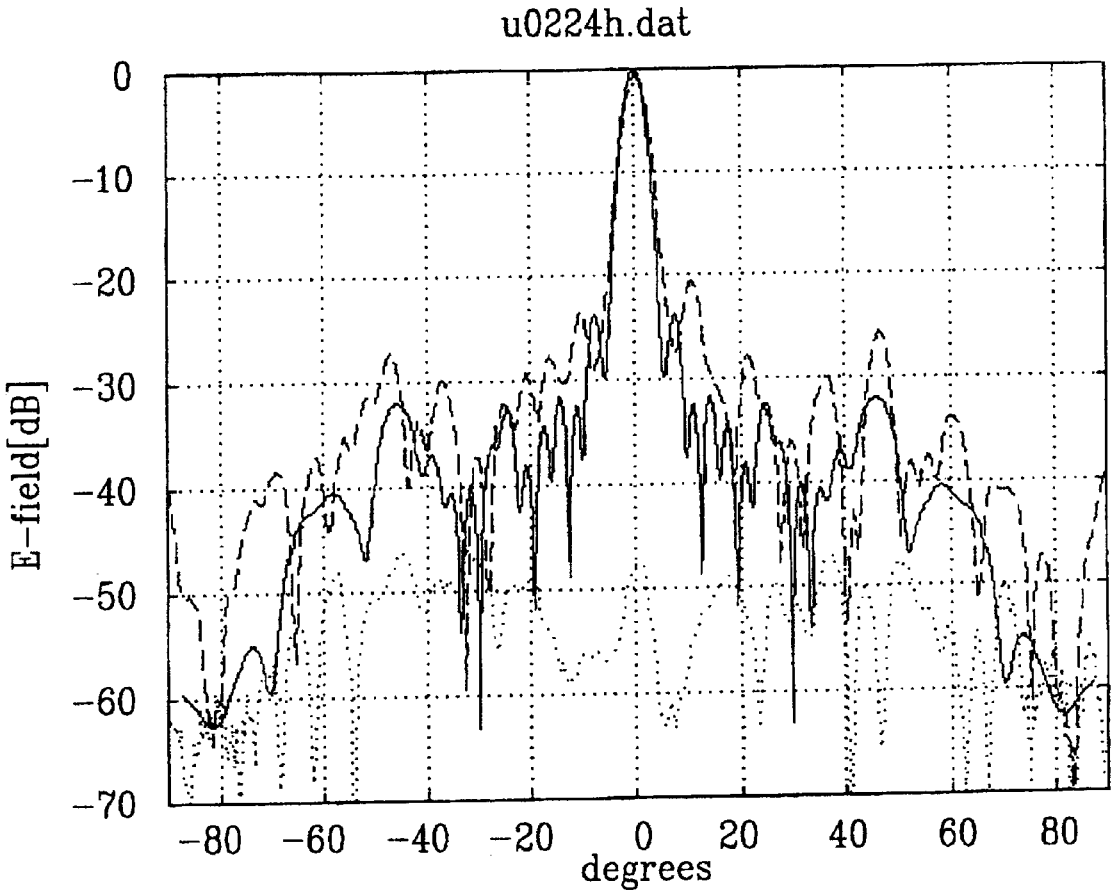
FIG. 5 is the E-plane analysis of the center-fed broad side lobe antenna of FIG. 4.

FIG. 5 shows the E-plane analysis of the center fed broad side lobe antenna at approximately 22.4 GHz. It is evident that the antenna pattern does not have any major grating lobes and a quite narrow 3 dB beam width, approximately 3.6 degrees in the E-plane and the antenna pattern is symmetric. In the graph, the solid line illustrates the synthesised co-polar radiation, the dashed line measured co-polar radiation and the dotted line the measured cross-polar radiation.

The refocusing of the main lobe and the slight shift of the side lobes, which can be seen, are most likely due to the fact that the test reflector, which was used during the measurements, was not totally flat. Gluing the reflector to a backplate can alleviate this problem. The side lobes at angles above 90 degrees are due to spillages from the feeder and are to be expected. Moreover, the feeder blocks some of the radiation and this of course effects the antenna pattern, which can be compensated for.

The maximum gain in the range of 21.2 to 23.6 GHz was 32.73 dBi. This is an acceptable level for testing equipment even though it is almost four dB below the maximum gain of 36.4 dBi. Table 1, provides the gain for the center frequency and the outer bandwidth limits.

TABLE 1

| Frequency [GHz] | Gain [dBi] |
|---|---|
| 21.20 | 31.48 |
| 22.40 | 32.05 |
| 23.60 | 31.03 |

Figure 6:
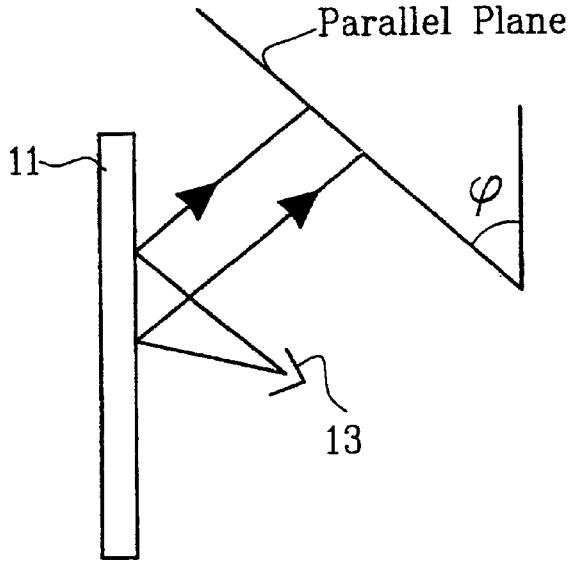
FIG. 6 is schematic side view of a center-fed antenna with a tilted lobe.

The second example concerns a center-fed antenna with a tilted main lobe, as presented in FIG. 6.

For the calculation of the phase shift needed in the dipoles, same method as above mentioned broadside antenna is used, with only difference that the phase should not be constant in a plane perpendicular to the broadside but instead tilted in an angel $\phi$ (e.g. 40°) from it.

Thus, the phase length is calculated by modifying the equation (2):

$$Phaselength = \left(\sqrt{z^2+x^2+y^2} + x.\sin\phi\right)\cdot\frac{2\pi}{\lambda} \tag{11}$$

where $\phi$ is the angle that the main lobe is tilted.

The remaining calculations are identical to the calculations in the broadside case.

Figure 7B:
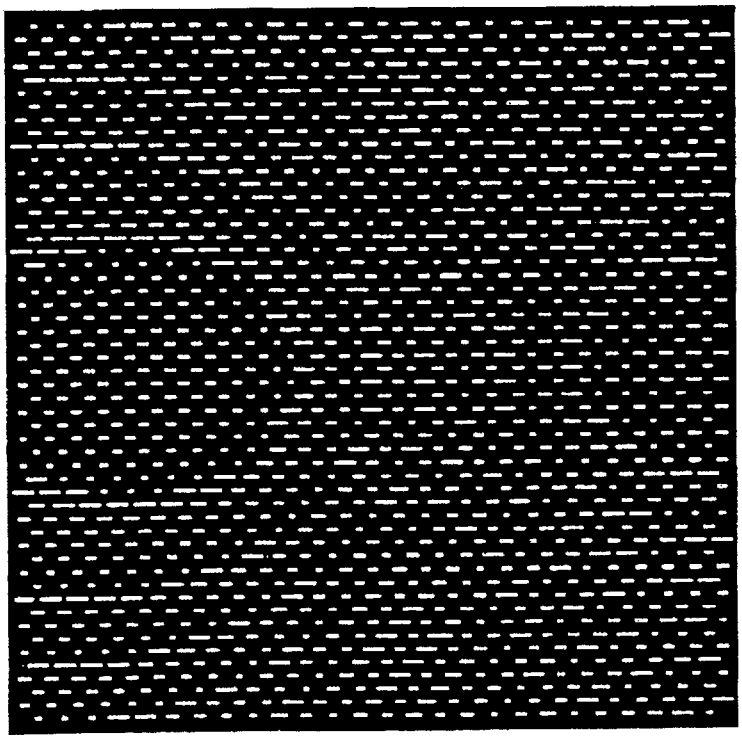
FIG. 7B is dipole structure of the center-fed antenna with tilted lobe according to FIG. 6.

FIG. 7B shows the dipole pattern for a center fed antenna reflector with a tilted lobe. It appears from the figure that shorter (horizontally situated) dipoles are concentrated to one side (left side) of the reflector forming a partly circular pattern and they are also surrounded by substantially half circular patterns of long and short dipoles, respectively. However, some small half circular patterns are also apparent at each edge of the reflector. Preferably, the dipoles are arranged in different layers.

Figure 8:
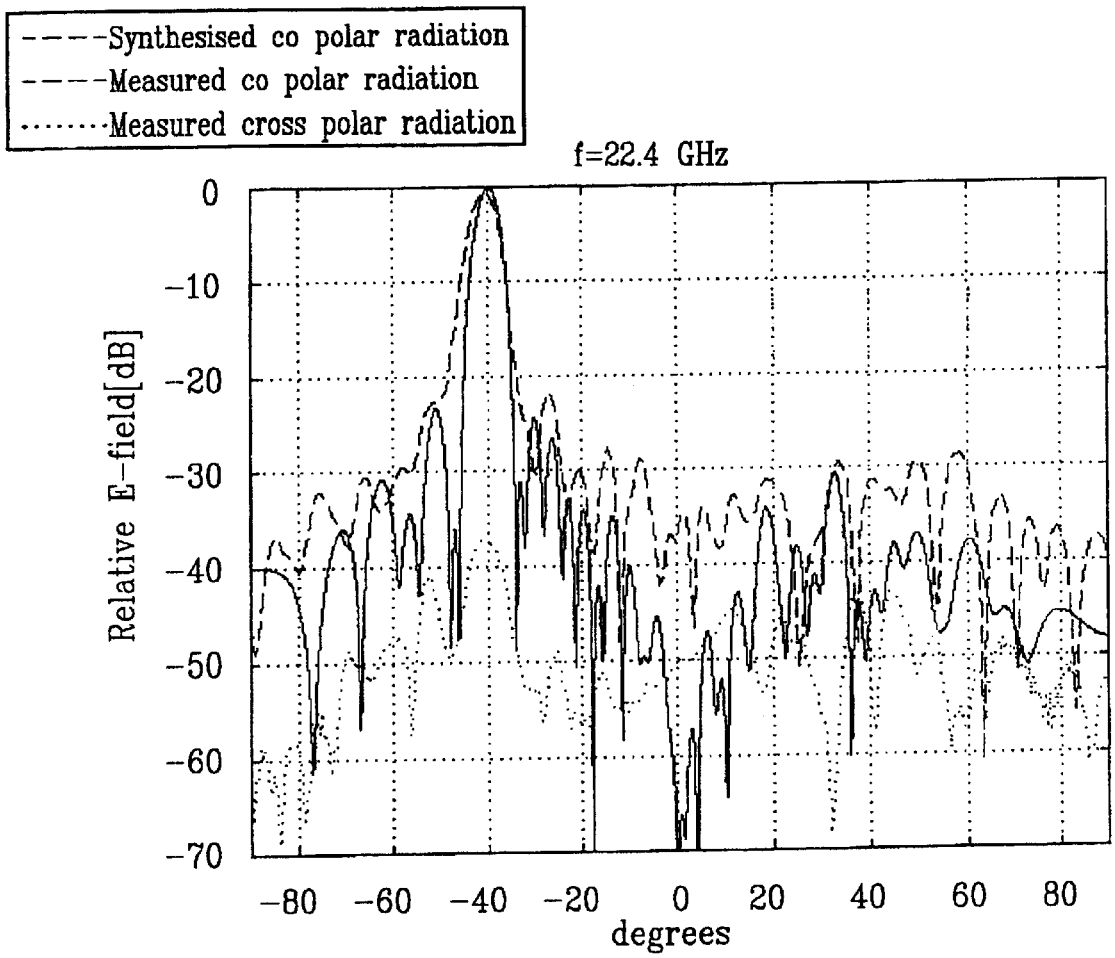
FIG. 8 is the E-plane analysis of the center-fed tilted lobe antenna of FIG. 6.

FIG. 8 shows the E-plane analysis of the center fed antenna with the tilted lobe at approximately 22.4 GHz. This antenna has the same characteristics as the previously described antenna except for the lobe that is tilted $\phi$ degrees in horizontal plane. Even this antenna has small grating lobes and it has a sharp beam, which is pointed $\phi$ degrees, i.e. 40° from the broadside. In the graph, the solid line illustrates the synthesised co-polar radiation, the dashed line measured co-polar radiation and the dotted line the measured cross-polar radiation.

The measured gain versus frequency for the antenna with a tilted main lobe is shown in Table 2.

TABLE 2

| Frequency [GHz] | Gain [dBi] |
|---|---|
| 20.0 | 24.2 |
| 21.2 | 29.3 |
| 22.4 | 30.1 |
| 23.6 | 28.7 |
| 25.0 | 25.1 |

Figure 9:
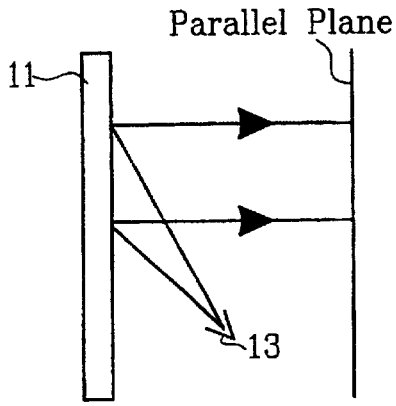
FIG. 9 is schematic side view of an offset-fed antenna with a broadside lobe.
Figure 10:
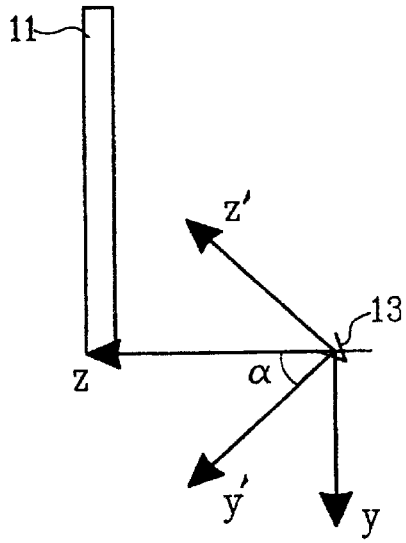
FIG. 10 is a coordinate system for the offset-fed antenna according to FIG. 9.
Figure 11:
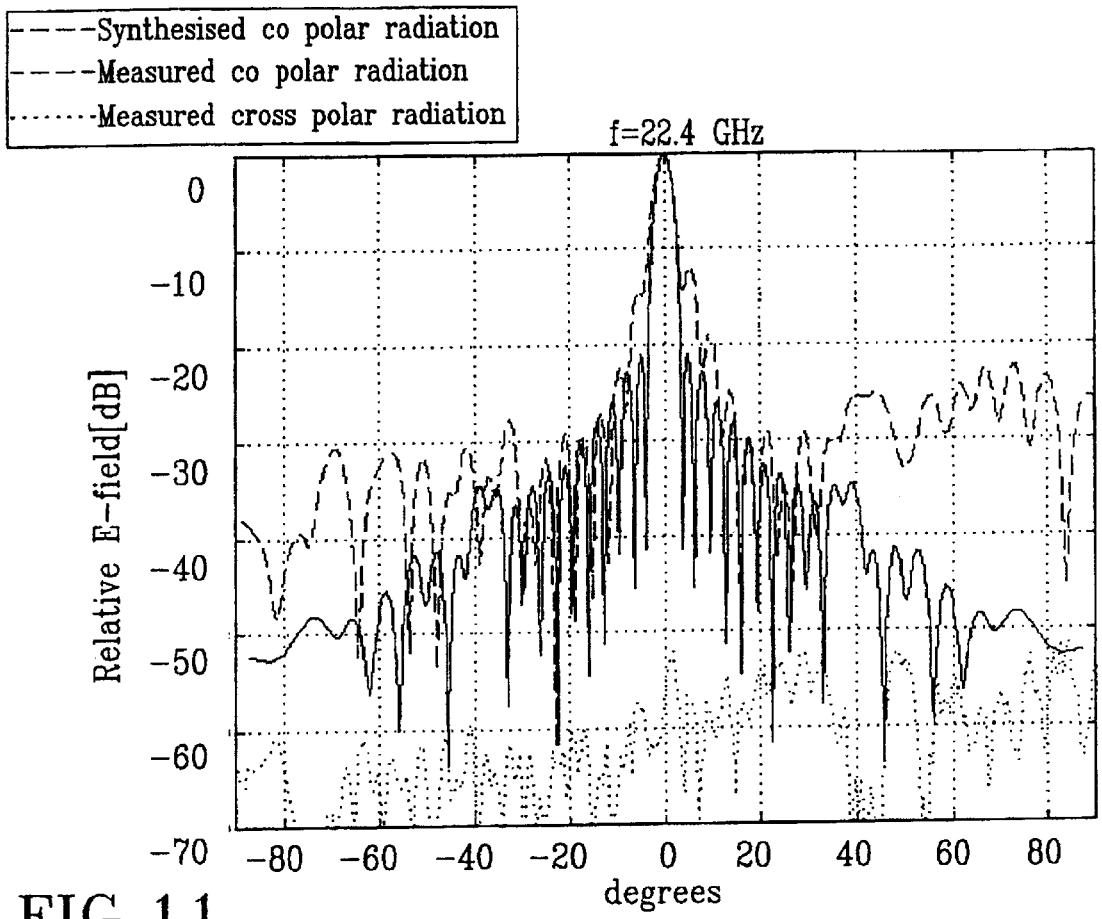
FIG. 11 is the E-plane analysis of the offset-fed broadside lobe antenna of FIG. 9.

The third example relates to an offset fed antenna, as illustrated in FIG. 9. The offset fed antenna is similar to both the broadside and the tilted antenna in that it has a plane where the phase is constant. The main difference is not only that the feeder 13 is arranged offset to one side of the reflector 11, but also that the feeder is tilted towards the center of the antenna. This requires that the coordinate systems must be redefined, which is shown in FIG. 10.

The following equations transform the previous coordinates to the new ones:

$$x'=x$$
$$y'=y.\ \cos(\alpha)+z\ .\ \sin(\alpha) \quad (12)$$
$$z'=z.\ \cos(\alpha)-y\ .\ \sin(\alpha)$$

and $$x'=r.\ \sin(\theta')\ .\ \cos(\phi')$$
$$y'=r.\ \sin(\theta')\ .\ \sin(\phi') \quad (13)$$
$$z'=r\ \cos(\theta'),$$

where $$r=\left(\sqrt{x^2+y^2+z^2}\right) \quad (14)$$

$$\theta'=a\cos\left(\frac{z\cdot\cos(\alpha)-y\cdot\sin(\alpha)}{r}\right) \quad (15)$$

$$\phi=a\tan\left(\frac{z\cdot\cos(\alpha)+y\cdot\sin(\alpha)}{r}\right). \quad (16)$$

This changes the phase length to the constant phase plane, which is now calculated using equation (17) and then proceeding in the same way as the previous two antennas.

$$Phaselength= \quad (17)$$
$$\left(\sqrt{z^2+(x-x_{offset})^2+(y-y_{offset})^2)}+x\cdot\sin\phi\right)\cdot\frac{2\pi}{\lambda}$$

Figure 7C:
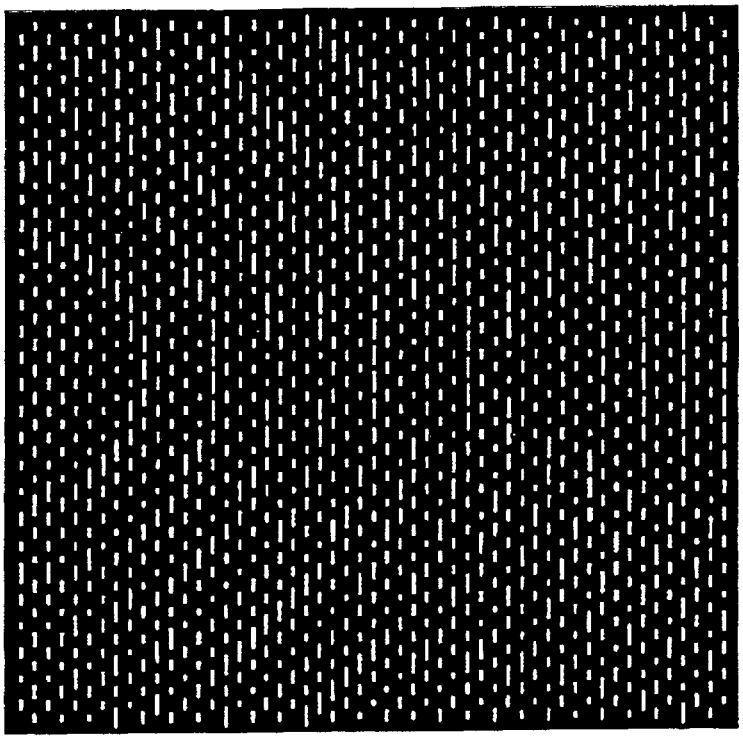
FIG. 7C is dipole structure of the center-fed with tilted main lobe.

FIG. 7C shows the dipole pattern for an offset fed antenna reflector. It appears from the figure that shorter dipoles are concentrated to the upper section of the reflector (with respect to the drawing's plane) forming a half circle and they also are surrounded by substantially half circular patterns of long and short dipoles, respectively. The dipoles are preferably arranged in two more layers.

Figure 13:
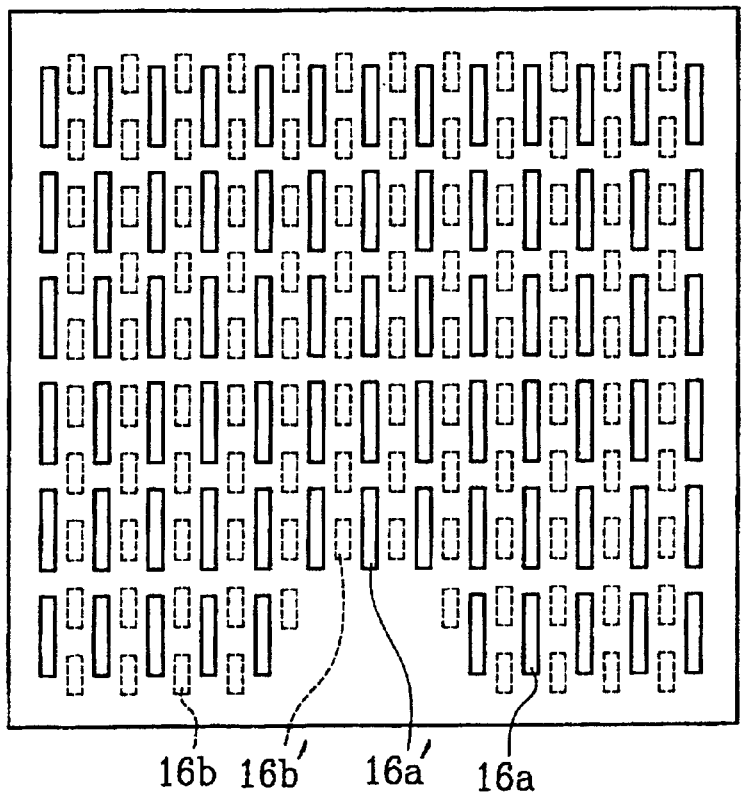
FIG. 13 is another embodiment of a reflector according to the invention.

FIG. 13 shows the E-plane analysis of the offset-fed antenna at approximately 22.4 GHz.

Preferably, the feeder 13 is placed in the middle above one edge of the antenna and is pointed towards the center of the antenna. The antenna pattern is once again changed to achieve a broadside lobe. The antenna pattern is not symmetric and the grating lobes are somewhat higher compared to the previous antennas. In the graph, the solid line illustrates the synthesised co-polar radiation, the dashed line measured co-polar radiation and the dotted line the measured cross-polar radiation.

The gain versus frequency for antenna with offset feed is provided in Table 3.

TABLE 3

| Frequency [GHz] | Gain [dBi] |
|---|---|
| 21.2 | 30.1 |
| 22.4 | 29.9 |
| 23.6 | 29.6 |

Figure 14:
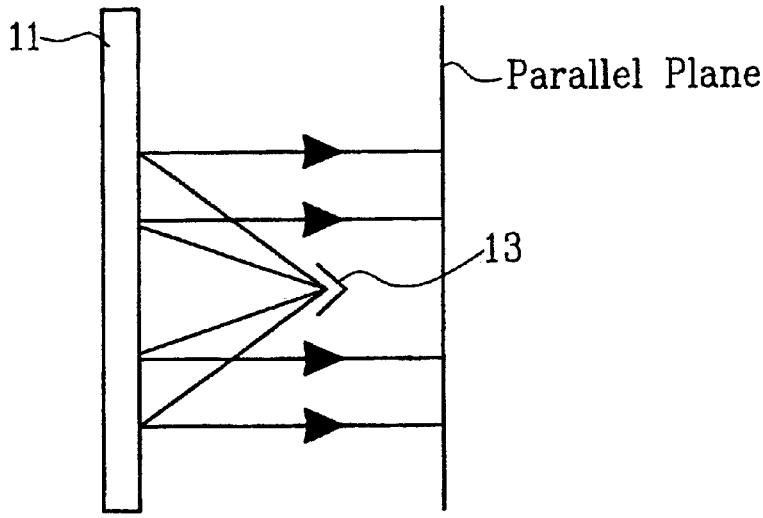
FIG. 14 is schematic side view of a PMP antenna.

The fourth example relates to a Point-to-Multi Point (PMP) antenna, as illustrated in FIG. 14. The PMP-antenna is a new concept having major advantages in signal transmission systems. The PMP antennas are a new component of the wireless data transfer systems. They act as nodal points and communicate with several other link antennas. The construction of a PMP-antenna is much more complicated than the other antennas mentioned above. The beam width in the horizontal plane has to be 90 degrees and in the vertical plane it has to be 10 degrees, with some restrictions on grating lobes and gain. In the design procedure, the Franceschetti Bucci method to create the wanted shape of the antenna pattern is therefore used.

This antenna is more difficult to synthesise because of the demand for the farfield antenna pattern to have a specific shape, which means that there will not be a constant phase plane. To calculated the needed phase shifts from the dipole antennas, an iterative method called Franceschetti Bucci method is used.

Franceschetti-Bucci method is an effective method for array pattern synthesis and utilizes an iterative procedure. The wanted antenna pattern is determined by an upper and lower mask, which control the upper and lower limit of the wanted antenna pattern.

The first step in the synthesis procedure is to excite the dipoles and the determine the farfield antenna pattern by using Fast Fourier Transform (FFT). The masks are then applied to the farfield antenna pattern and the modified pattern is transformed back to the aperture distribution using Inverse Fast Fourier Transform (IFFT). A feature with the FFT is that if there are N excitation points then there will be N points in the farfield pattern, which equals one farfield point per lobe and that is poorly insufficient. A method to avoid this problem is to zero-pad the excitation matrix so that the number of farfield points is acceptable. This generates more farfield points but also a larger excitation matrix which must therefore be truncated to the correct size. The new excitation matrix is then zero-padded and Fourier transformed starting the whole procedure again. When this iterative procedure is completed, the wanted antenna pattern is achieved. However, the Franceschetti-Bucci method can only be used when the aperture has a rectangular pattern. As the antenna according to the present invention has a triangular pattern with a different radiation field function on every dipole, the solution is to synthesise with a period, which is twice as big in the FFT. When the iterative period is completed, every other dipole is removed to achieve a triangular aperture pattern. Generally, using the Franceschetti-Bucci method synthesis, it is possible to control both the amplitude and phase of the radiation from each element.

In the synthesis all dipoles have a different radiation field function and the amplitude from each dipole dependents on the distance from the dipole to the feeder and the feeders element pattern. Except for the fact that Franceschetti-Bucci method is only valid when the aperture is rectangular, the physical limitations in the phase shift must be considered. The dipoles, where the wanted phase shift coincides with the phase gap, are given the length which best provides the wanted phase shift.

Figure 15:
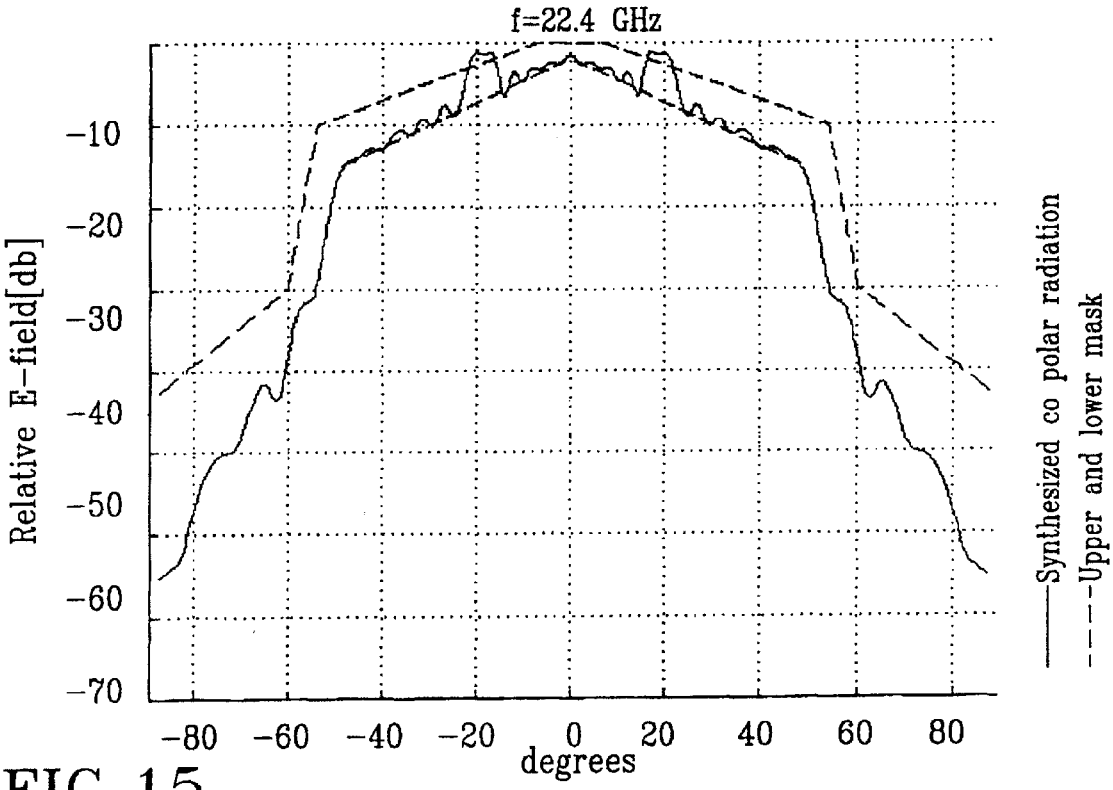
FIG. 15 is the E-plane analysis of the PMP antenna of FIG. 14.

The result of the analysis of the synthesised PMP antenna for E-field is shown in FIG. 15.

Figure 7D:
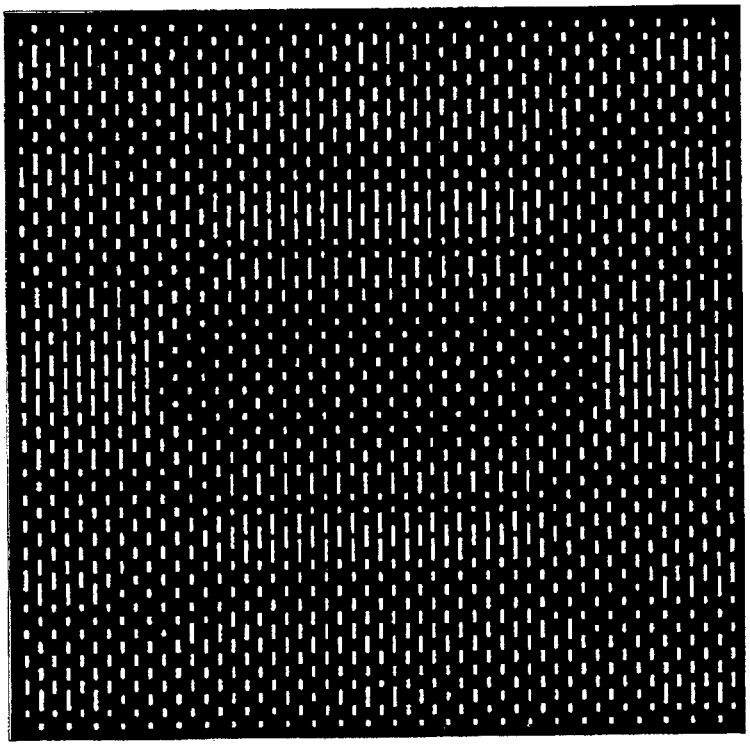
FIG. 7D is dipole structure of an offset-fed antenna with broadside lobe according to FIG. 14.

FIG. 7D shows the dipole pattern for the center-fed PMP antenna reflector. It appears from the figure that shorter dipoles are concentrated to the center section of the reflector forming a substantially rectangular pattern with substantially circular short sides.

Figure 16:
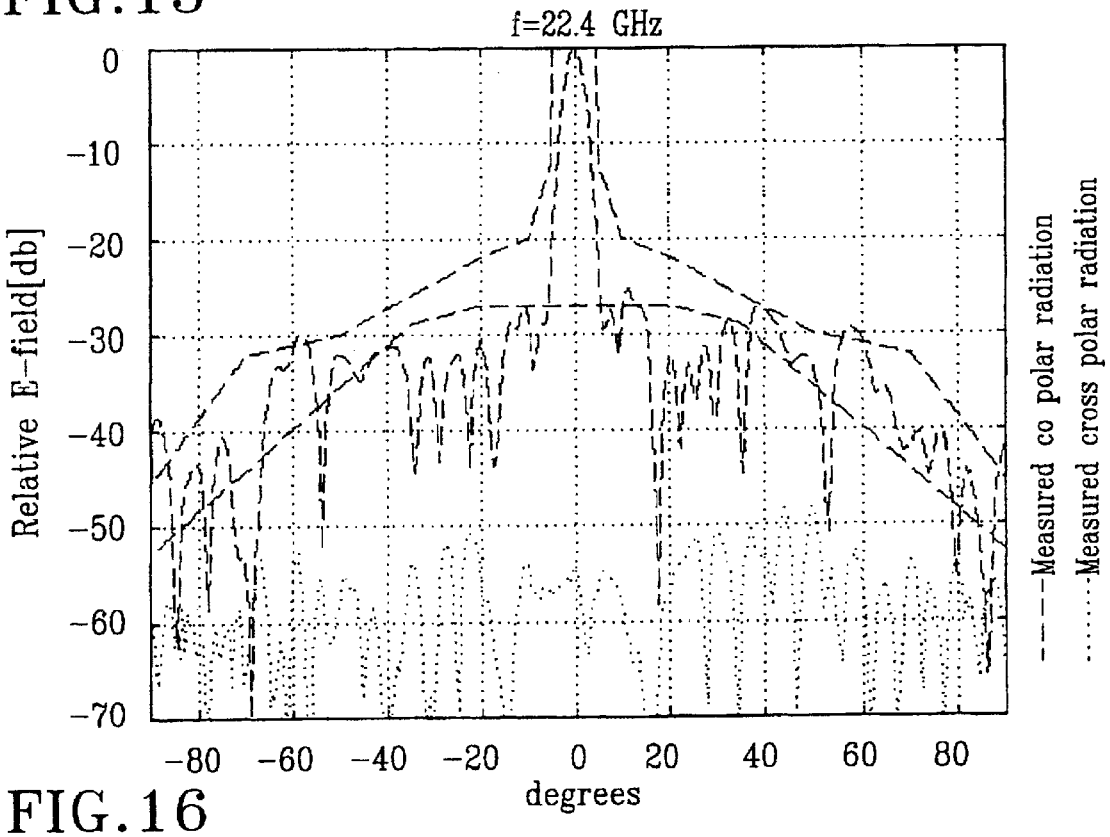
FIG. 16 is the etsi2 specification for the center-fed antenna with a broadside lobe according to the present invention.

The bandwidth of the antennas according to the present invention is surprisingly large, about 3.6 GHz which is 16% of the center frequency. FIG. 16 shows the bandwidth analysis for two center fed antennas, the broadside lobe and when the main lobe is tilted 40 degrees.

Figure 17:
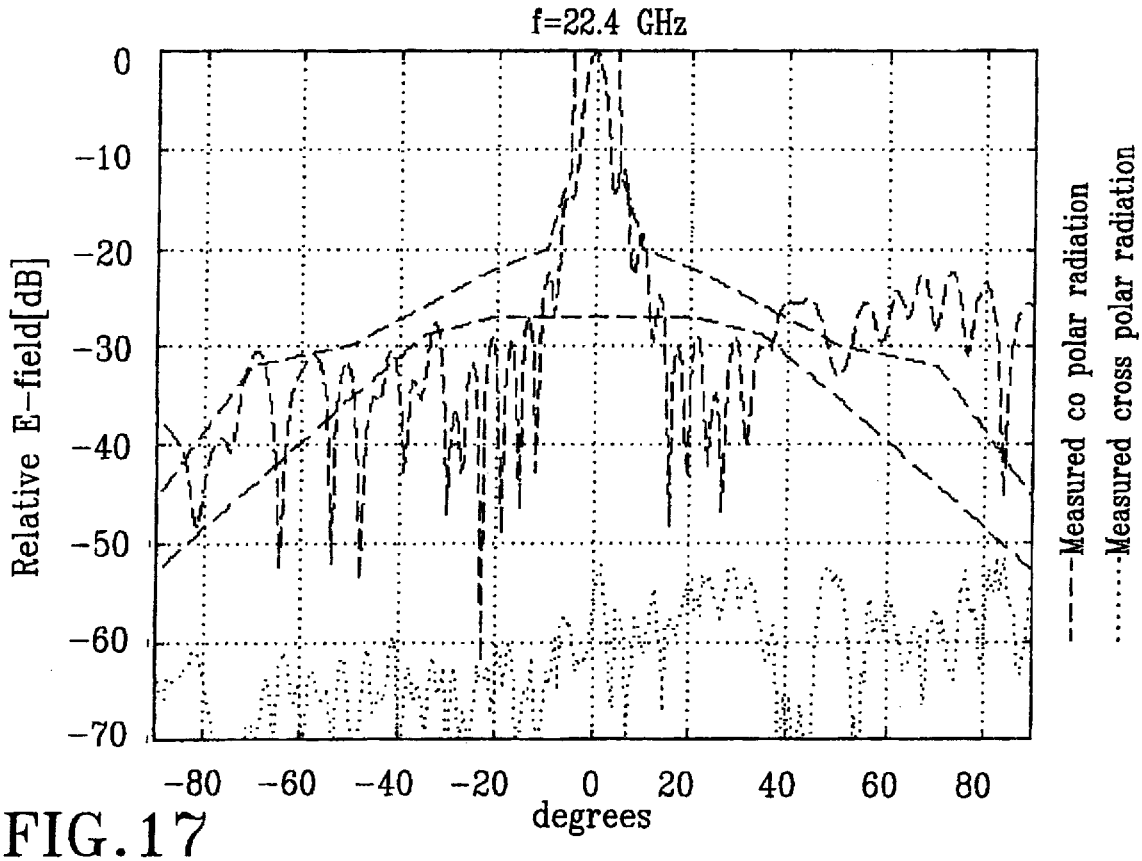
FIG. 17 is the etsi2 specification for the center-fed antenna with a tilted lobe according to the present invention.
Figure 18:
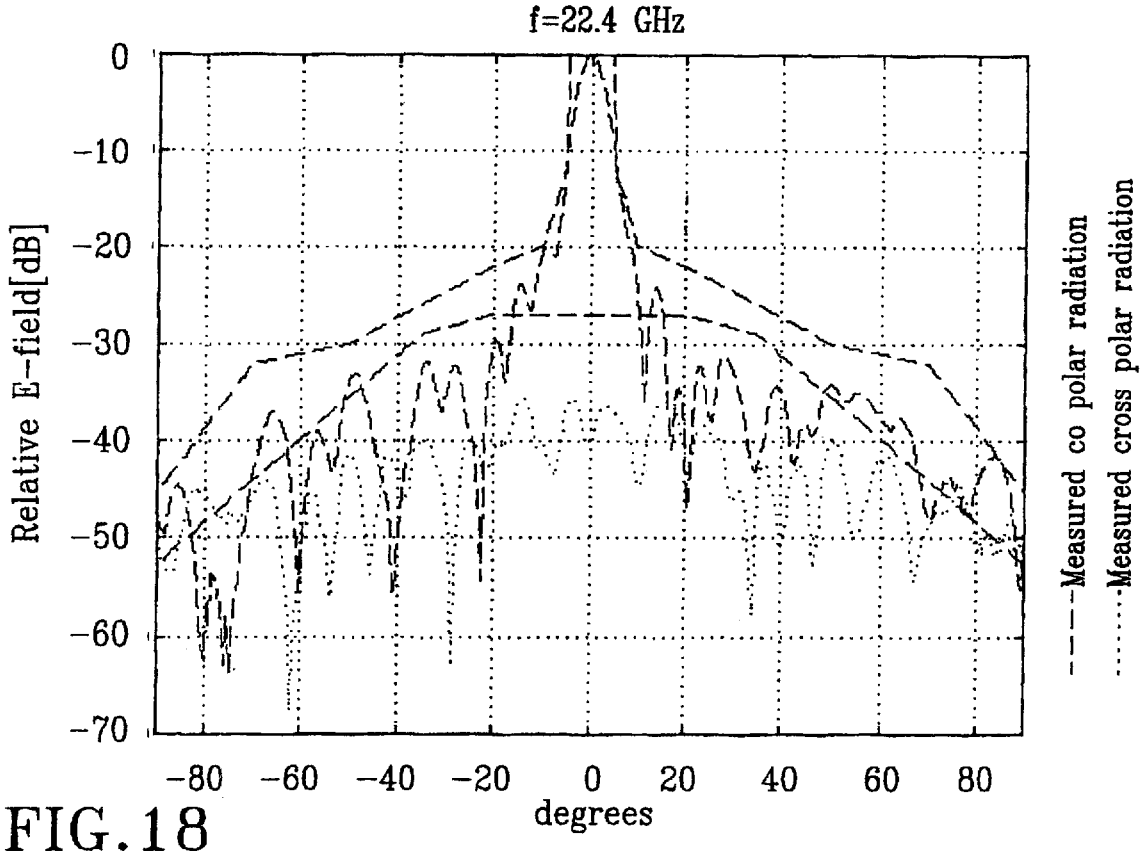
FIG. 18 is the etsi2 specification for the offset-fed antenna with a broadside lobe according to the present invention.

The antennas can be ranked in different antenna classes dependent on how well the antenna pattern is shaped. These criterions are called "ETSI specifications". FIG. 16 shows the etsi2 specifications for the center-fed antenna with broad side lobe; FIG. 17 shows the etsi2 specifications for the offset-fed antenna with broad side lobe; and FIG. 18 shows the etsi2 specifications for the center-fed antenna with 40° tilted lobe.

It is one advantage of the invention that multiple lobe shapes and/or directions can be obtained using different dipole patterns, shapes and lengths in different layers, preferably for different frequencies.

Figure 19:
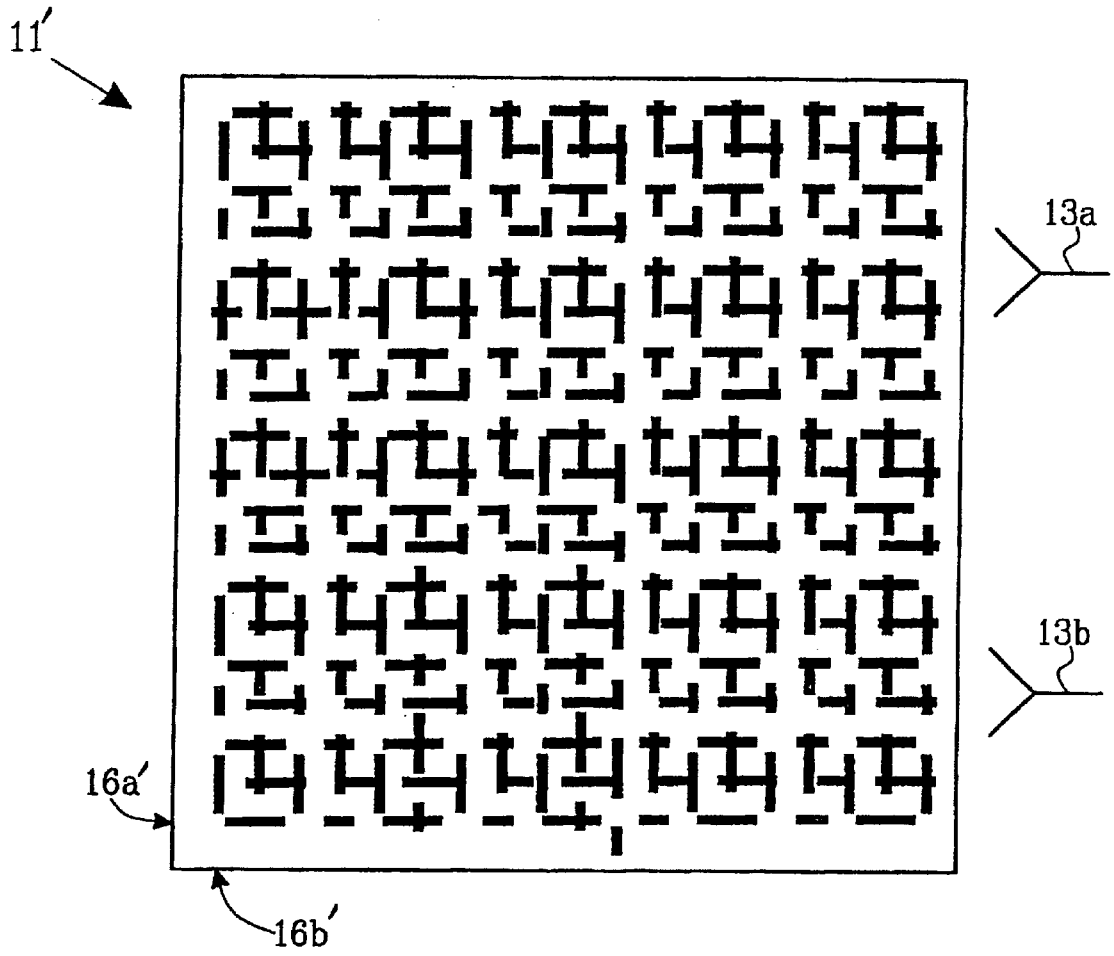
FIG. 19 is another embodiment according to the present invention.
Figure 20:
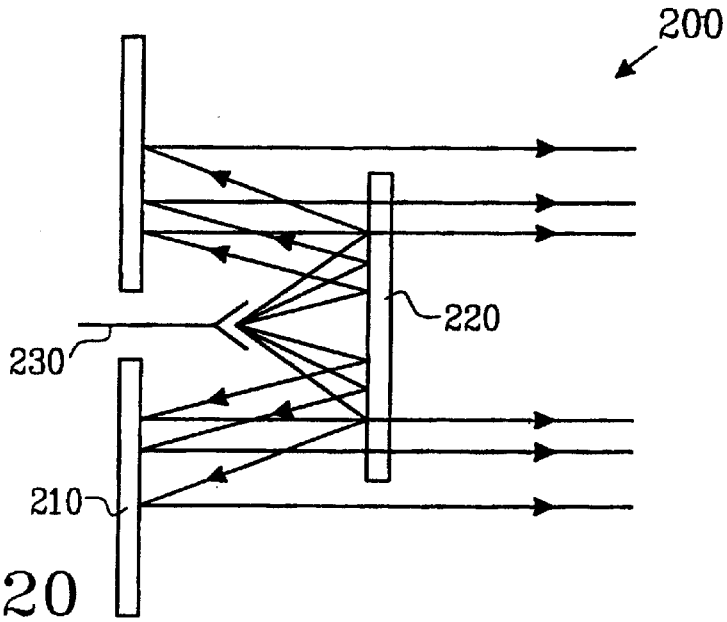
FIG. 20 is a cross-sectional view of an antenna including reflectors according to the present invention.

FIG. 19 shows another embodiment, in which the reflector 11' serves two feeders 13*a* and 13*b*. The reflector is provided with two layers of dipoles 16*a*' and 16*b*', arranged in horizontal and vertical directions, receptively, for each feeder. Preferably, the dipoles are perpendicular to each other and there is no mutual relationship between the layers. The feeders may feed the corresponding layer with different polarisations and/or frequencies.

Figure 12:
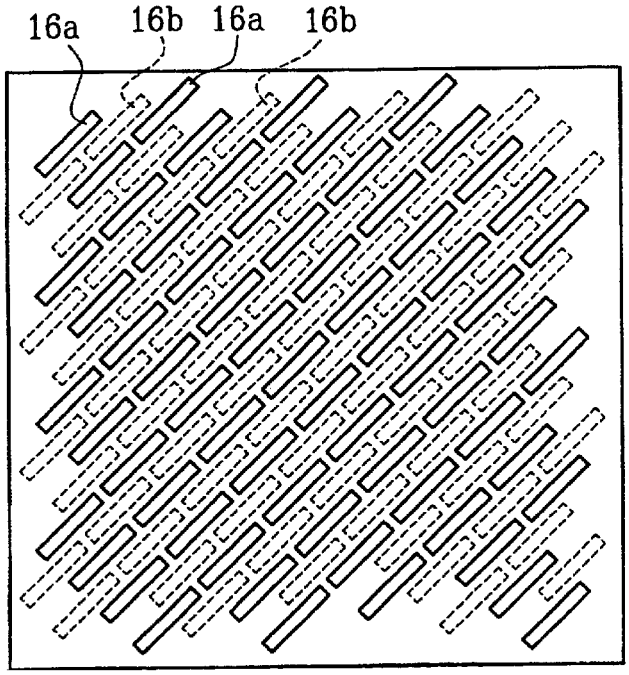
FIG. 12 is an embodiment of a reflector according to the invention.

It is also possible to arrange the dipoles in diagonal direction as shown in FIG. 12. The substantially orthogonal dipoles 16*a* and 16*b* are arranged on different layers. This arrangement allows longer dipoles and more compact configuration of the reflector. However, non-orthogonal dipoles can be provided for wide band applications.

The dipoles may also be arranged only in one direction, e.g. substantially vertically (or horizontally) as shown in FIG. 13. The dipoles are arranged in different layers. The dipoles 16*a* and 16*a*' are arranged in the first layer are substantially longer than the dipoles 16*b* and 16*b*'. Moreover, the dipoles in each layer have different lengths.

Due to the advantages of the reflectors according to the invention, they can be used in wide range of applications. A "Cassegrain antenna", for example, is a very suitable application (see "Antenna Research and Development at Ericsson", by Olof Dahlsjö, IEEE Antennas and Propagation Magazine, Vol. 34, No. 2, April 1992, pages 7–17.)

Figure 21:
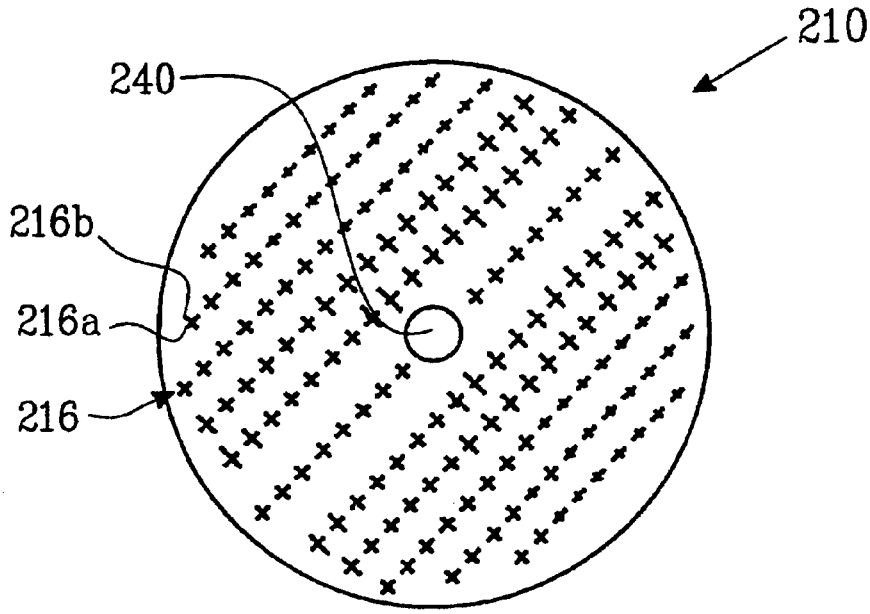
FIG. 21 is a reflector according to the FIG. 20 produced in accordance with the present invention.
Figure 22:
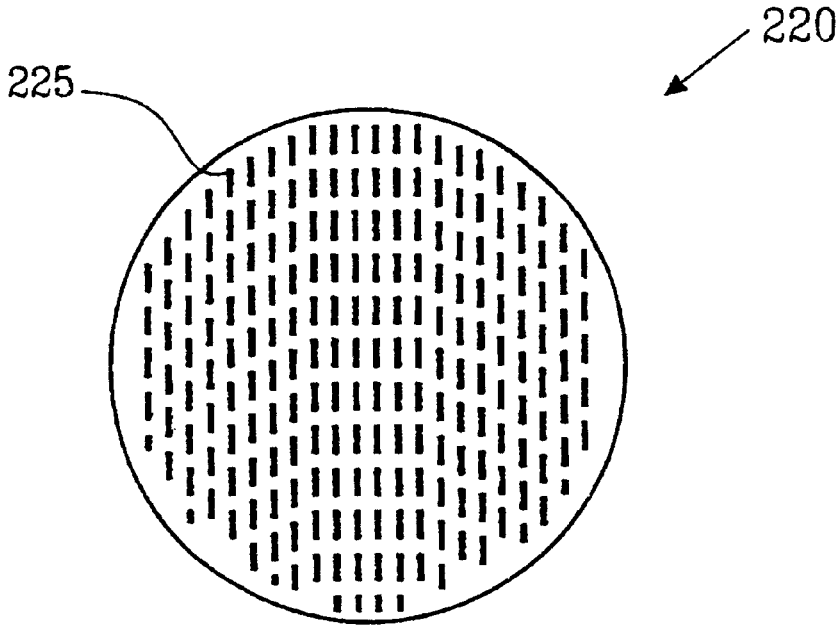
FIG. 22 is another reflector according to the FIG. 21 produced in accordance with the present invention.

FIGS. 21 and 22 show an example of a Cassegrain type antenna employing reflectors according to the present invention. The antenna 200 mainly comprises a main reflector 210 a sub-reflector 220 and feeding arrangement 230 arranged in the centre of the main reflector 210. The frontal view of the sub-reflector 220 shows that the reflector comprises substantially horizontal (or vertical) dipoles 225. The sub-reflector is arranged to reflect vertically (or horizontally) polarised electromagnetic waves and it is transparent to horizontally (or vertically) polarised waves. The dipoles are arranged in one or two layers or planes.

The main reflector 210 is provided with substantially cross-shaped dipoles 216, comprising first and second dipole elements 216*a* and 216*b*. The mutual angle between the dipole elements of each reflector is approximately 45°, i.e. the angle between the dipoles of the main reflector and the sub-reflector. The configuration of the cross-shaped dipoles results in a polarization rotation from horizontal to vertical (or from vertical to horizontal). In the center of the main reflector 210, is provided an opening 240 for the feeder 230.

In operation, a vertically polarized electromagnetic wave fed from the feeder 230 is reflected by the sub-reflector 220 towards the main reflector, which rotates the polarization of the wave from the vertical to horizontal and reflects it through and around the sub-reflector. Due to the invention a Cassegrain type antenna becomes more compact. Moreover, the reflectors can easily be changed to provide different functionalities. It is also possible to use reflectors having one layered dipole structure.

A correctly arranged cross-shaped dipole with suitable length combination will result in circular polarization.

Figure 23:
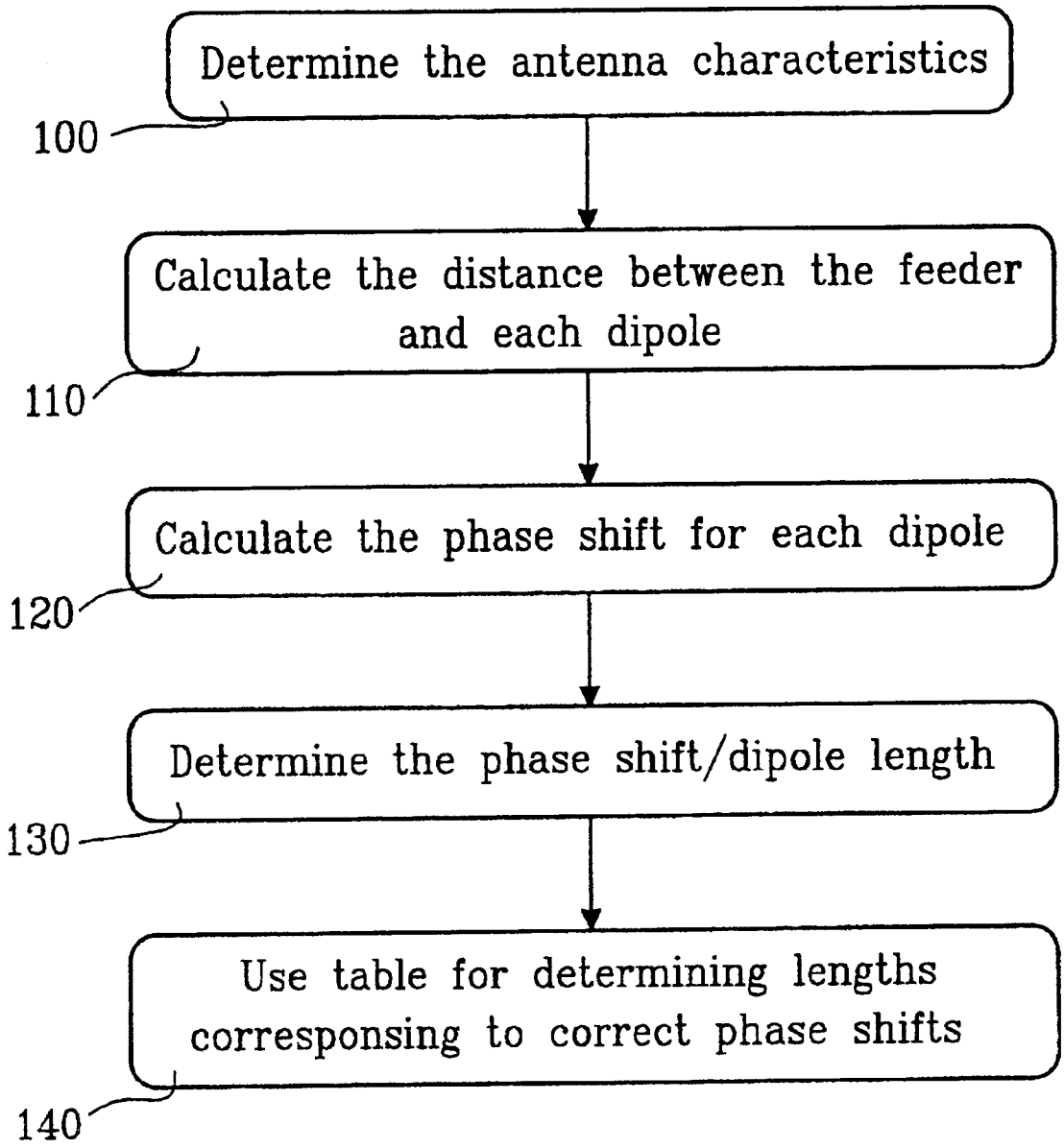
FIG. 23 is a flow diagram showing the manufacturing steps of an antenna according to the present invention.

When manufacturing the antenna reflector, preferably a computer program is used to generate the dipole pattern, and lengths. The program results in a etch negative, which is used for etching the antenna plates. The reflector can be produced quickly and relatively cheaply using existing circuit board manufacturing technology. The manufacturing steps are illustrated in the flow diagram of FIG. 23.

In the first step 100, the characteristics of the antenna employing the reflector are determined and entered, the characteristics may include the antenna size, type, frequency band, feeder type, feeder size etc.

With respect to the input characteristics the distance between the feeder and each dipole is calculated 110. Then the phase shift for the dipoles is calculated at 120. Here, the equation (5) is used.

The calculated phase shift is used for calculating the dipoles' lengths, 130. For this purpose an analysing procedure is used, which analyses a microstrip dipole surrounded by an infinite number of identical dipoles. The procedure analyses dual layer dichroic structures. The dichroic structures that can be handled by the method consist of two parallel metallic screens (gratings) separated by one/several dielectric layers. The grid structures are assumed to consist of thin metallic crossed or single dipoles.

The procedure conducts an analyses of a single grating surrounded by a number of dielectric layers that are considered to be electrically close to the grating. The closest dielectric layers must be included at this stage due to the storage energy in the evanescent field surrounding the grating. The analyses are carried out according to the method of moment solution of an integral equation formulation and as such requires information regarding the number of expansion modes and truncation limits for suitable convergence.

Then the dipoles' length are determined, 130, e.g. using (depending on the antenna type) equations 4, 13 and 19.

When testing the antennas according to the present case, the spacing was less than 6.7 mm so a length of 6.5 mm was chosen. The thickness of the dielectric material was also varied and not the dielectric constant and a low loss material called TLC30 was used, which has a dielectric constant of 3.0. This material is relatively cheap and has good mechanical and electrical properties. The size of the reflectors was 250×250 mm.

There is also an advantage with the present invention is that when serving, repairing or changing the configuration of an antenna or antenna site, the authorised personal can easily carry a number of reflectors and change to a new one or a new configuration if needed. The invention also facilitates the adjustment of the antennas, e.g. through small adjustments of the feeder.

As described above, dipoles can be arranged in different layers on separate substrates; however, it is also possible to arrange the dipoles on different sides of one substrate.

The invention is not limited the shown embodiments but can be varied in a number of ways without departing from the scope of the appended claims and the arrangement and the method can be implemented in various ways depending on application, functional units, needs and requirements etc.

What we claim is:

1. A microwave phasing structure for electromagnetically emulating a desired reflective surface of selected geometry in order to achieve phase-coherency of an incident electromagnetic wave at a focal point, comprising:

a multi-layer support member;

a reflective member supported by said support member, configured to reflect microwaves within a predetermined operating frequency band; and a phasing arrangement of electromagnetically-loading structures that are interspaced from each other and disposed at a distance from said reflective member by the support member so as to provide the emulation of the desired reflective surface of selected geometry, wherein each electromagnetically-loading structure comprises a plurality of elements, each of said elements being arranged in different planes, arranged on different layers of the multilayer support member and insulated one from the others by said support member.

2. The microwave phasing structure of claim 1, wherein the electromagnetically-loading structures are dipoles.

3. The microwave phasing structure of claim 2, wherein at least one element of each dipole is arranged on one side of each layer of said support member in parallel with at least one element of all other dipoles.

4. The microwave phasing structure of claim 2, wherein pairs of the dipoles are arranged in a substantially cross-shaped configuration each having a first element on one plane insulated from a substantially orthogonally second element arranged on a different plane.

5. The microwave phasing structure of claim 2, wherein the dipoles have different sizes.

6. The microwave phasing structure of claim 2, wherein the dipoles have different shapes.

7. The microwave phasing structure of claim 2, further comprising a feeder having a phase center, wherein a length of each dipole is a function of a distance from the phase center of the feeder to a point on a plane that is perpendicular to the incident electromagnetic wave.

8. The microwave phasing structure of claim 7, wherein each dipole is further configured to emulate an area of the desired reflective surface of selected geometry by providing a phase shift of the incident electromagnetic wave, the required phase shift being calculated according to:

phase shift=phase dipole+phase adjust wherein plane phase=phase length+phase shift, and wherein plane phase is the phase at the perpendicular plane.

9. The microwave phasing structure of claim 8, wherein the phase adjust is determined so that a minimized number of dipole phase shifts are included in a phase gap.

10. The microwave phasing structure of claim 7, wherein said microwave phasing structure is a component of a center-fed antenna with a tilted main lobe and wherein the phase length is calculated according to:

$$Phaselength = \left(\sqrt{z^2 + x^2 + y^2}\right) \cdot \frac{2\pi}{\lambda}$$

where x, y and z are coordinates in a Cartesian coordinate system with the origin in the phase center of the feeder and λ is the wavelength of the radiated electromagnetic wave.

11. The microwave phasing structure of claim 7, wherein said microwave phasing structure is a component of an offset-fed broad side antenna and wherein the phase length is calculated according to:

$$Phaselength = \left(\sqrt{z^2 + x^2 + y^2}\right) + x \cdot \sin\phi\right) \cdot \frac{2\pi}{\lambda}$$

where ϕ is the angle at which the main lobe is tilted.

12. The microwave phasing structure of claim 7, wherein said microwave phasing structure is a component in an arrangement selected from a group including of a Point-to-Point antenna and a Point-to-Multipoint antenna and wherein the phase length is calculated according to:

$$Phaselength = \left(\sqrt{(z^2 + (x - x_{offset})^2 + (y - y_{offset})^2)} + x \cdot \sin\phi'\right) \cdot \frac{2\pi}{\lambda}$$

wherein $$\theta' = a\cos\left(\frac{z \cdot \cos(\alpha) - y \cdot \sin(\alpha)}{r}\right)$$

$$\phi' = a\tan\left(\frac{z \cdot \cos(\alpha) + y \cdot \sin(\alpha)}{r}\right).$$

13. The microwave phasing structure of claim 1, wherein pairs of elements of the electromagnetically-loading structures are arranged in a substantially cross-shaped configuration each having a first element on one plane insulated from a substantially orthogonally directed second element arranged on a different plane.

14. The microwave phasing structure of claim 13, wherein the first elements of the electromagnetically-loading structures are arranged in parallel with respect to one another and at an angle with respect to the sides of the reflective member.

15. The microwave phasing structure of claim 1, wherein the electromagnetically-loading structures have different sizes.

16. The microwave phasing structure of claim 1, wherein the electromagnetically-loading structures have different shapes.

17. The microwave phasing structure of claim 1, wherein said microwave phasing structure is a component of a center-fed broad side antenna.

18. The microwave phasing structure of claim 1, wherein said microwave phasing structure is a component of a center-fed antenna with a tilted main lobe.

19. The microwave phasing structure of claim 1, wherein said microwave phasing structure is a component of an offset-fed broad side antenna.

20. The microwave phasing structure of claim 1, wherein said microwave phasing structure is a component in an arrangement selected from a group including a Point-to-Point antenna and a Point-to-Multipoint antenna.

21. An antenna comprising an electromagnetic feeding arrangement and a reflector arrangement, said reflector arrangement comprising:

a microwave phasing structure supported by a multilayer support member;

a reflective member for reflecting microwaves within a frequency operating band; and a phasing arrangement of electromagnetically-loading structures that are interspaced from each other and disposed at a distance from said reflective arrangement by the support member and configured to provide emulation of a desired reflective surface of selected geometry and wherein each electromagnetically-loading structure comprises a plurality of elements, each of said elements being arranged in different planes, arranged on different layers of the support member and insulated one from the others by said support member.

22. The antenna of claim 21, wherein the electromagnetic feeding arrangement comprises at least one feeder for each plane.

23. The antenna of claim 21, further comprising an additional reflective member facing said reflector arrangement.

24. The antenna of claim 23, wherein said reflective member is arranged to reflect vertically or horizontally polarized electromagnetic waves and said additional reflective member is arranged to rotate and transform the reflected waves to horizontal or vertical polarization.

25. A microwave phasing structure for electromagnetically emulating a desired reflective surface of selected geometry in order to achieve phase-coherency of an incident electromagnetic wave at a focal point, comprising:

a phasing arrangement including a plurality of electromagnetically-loading structures, each of said electromagnetically-loading structures comprising a pair of elements, each of said elements being spaced apart in different planes, arranged on different layers and insulated one from the other.

26. The microwave phasing structure of claim 25, wherein said elements of each of said pair of elements are cross-oriented and short-free with respect to one another.

27. A method of producing a microwave phasing structure for electromagnetically emulating a desired reflective surface of selected geometry in order to achieve phase-coherency of an incident electromagnetic wave at a focal point that includes a phasing arrangement of a plurality of electromagnetically-loading structures, each of said electromagnetically-loading structures comprising a pair of elements, each of said elements being spaced apart in different planes and insulated one from the other, comprising:

arranging the electromagnetically-loading structures on different layers;

determining characteristics of an antenna employing a reflector;

calculating a distance between a feeder and each electromagnetically-loading structure with respect to the characteristics of the antenna;

calculating a phase shift required to be provided by each electromagnetically-loading structure; and using said calculated phase shift for calculating the length of the each electromagnetically-loading structure.

28. The method of claim 27, wherein determining characteristics of the antenna employing the reflector further comprises determining antenna size, antenna type, operating frequency band, feeder type, and feeder size.

29. The method of claim 27, wherein calculating the phase shift required to be provided by each electromagnetically-loading structure further comprises analyzing the phasing arrangement comprising a microstrip dipole surrounded by an infinite number of identical dipoles.

30. The method of claim 27, wherein calculating the phase shift required to be provided by each electromagnetically-loading structure further comprises analyzing the phasing arrangement comprising dual layer dichroic structures, which consist of two parallel metallic screens separated by at least one dielectric layer.

31. The method of claim 27, wherein calculating the phase shift required to be provided by each electromagnetically-loading structure further comprises analyzing the phasing arrangement comprising a single grating surrounded by a number of dielectric layers that are electrically proximate to the grating.

* * * * *